US012644288B2

(12) United States Patent
Livengood et al.

(10) Patent No.: US 12,644,288 B2
(45) Date of Patent: Jun. 2, 2026

(54) POST AND RAILING MOUNT

(71) Applicants: Derrick Livengood, Delta Junction, AK (US); Danielle Livengood, Delta Junction, AK (US)

(72) Inventors: Derrick Livengood, Delta Junction, AK (US); Danielle Livengood, Delta Junction, AK (US)

( * ) Notice: Subject to any disclaimer, the term of this patent is extended or adjusted under 35 U.S.C. 154(b) by 202 days.

(21) Appl. No.: 18/346,425

(22) Filed: Jul. 3, 2023

(65) Prior Publication Data

US 2024/0011299 A1 Jan. 11, 2024

Related U.S. Application Data

(60) Provisional application No. 63/358,331, filed on Jul. 5, 2022.

(51) Int. Cl.
*E04F 11/18* (2006.01)

(52) U.S. Cl.
CPC ... *E04F 11/1817* (2013.01); *E04F 2011/1821* (2013.01)

(58) Field of Classification Search
CPC . E04F 11/181; E04F 11/1812; E04F 11/1814; E04F 11/1817; E04F 2011/1819; E04F 2011/1821; E04H 17/006; E04H 17/1447; E04H 17/1488
See application file for complete search history.

(56) References Cited

U.S. PATENT DOCUMENTS 1,526,638 A * 2/1925 Knight ..... E04F 11/181 52/690
1,684,894 A * 9/1928 Smiley, Jr. ..... E04F 11/1812 52/223.5
1,756,023 A * 4/1930 Felsenthal ..... E04F 11/181 52/844
1,785,025 A * 12/1930 Felsenthal ..... E04F 11/181 138/171
4,367,864 A 1/1983 Eldeen
6,141,928 A * 11/2000 Platt ..... E04F 11/1814 52/832
6,308,937 B1 * 10/2001 Pettit ..... E04F 11/181 256/65.05
6,718,710 B2 * 4/2004 Platt ..... E04F 11/1814 52/296
6,826,875 B2 12/2004 Hasse
7,048,462 B2 5/2006 Lanphier
7,137,230 B2 11/2006 McCarthy
(Continued)

*Primary Examiner* — Jonathan P Masinick
(74) *Attorney, Agent, or Firm* — Boudwin Intellectual Property Law, LLC; Daniel Boudwin

(57) ABSTRACT

A post and railing mount is disclosed. The post and railing mount includes a mounting bracket having a plurality of vertical corner supports and a railing plate and a newel corner post having a plurality of corners, each of the vertical corner supports are secured to each of the corners. The post and railing mount also includes the vertical corner supports with a pair of perpendicular portions that wrap around the corners of the newel corner post. The perpendicular portions include a top perpendicular portion and a bottom perpendicular portion. The bottom perpendicular portion includes a plurality of apertures to accommodate a plurality of corresponding fasteners that extend through the apertures to attach the bottom perpendicular portion to a surface.

17 Claims, 6 Drawing Sheets

(56) References Cited

U.S. PATENT DOCUMENTS

| | | | | |
|---|---|---|---|---|
| 7,427,055 | B2 * | 9/2008 | Platt | E04H 17/1488 256/65.05 |
| 7,530,550 | B2 * | 5/2009 | Fattori | E04H 17/1447 256/65.05 |
| 7,533,506 | B2 * | 5/2009 | Platt | E04H 12/2261 52/296 |
| 7,677,000 | B2 * | 3/2010 | Walker | E04F 11/1812 248/539 |
| 7,731,160 | B2 * | 6/2010 | Terrels | E04F 11/1836 256/65.06 |
| 7,802,351 | B2 * | 9/2010 | McGinness | E04H 12/2253 29/458 |
| 8,167,275 | B1 * | 5/2012 | Bizzarri | E04F 11/181 256/65.02 |
| 8,814,145 | B2 * | 8/2014 | Herman | G01B 3/14 256/48 |
| 9,534,414 | B2 * | 1/2017 | Leary | E04H 12/2269 |
| 9,611,650 | B1 | 4/2017 | Bizzarri et al. | |
| 10,422,140 | B2 * | 9/2019 | Mitchell | E04F 11/181 |
| 10,767,386 | B2 * | 9/2020 | Hilliard | E04G 21/3223 |
| 11,236,511 | B2 * | 2/2022 | Henderson | E04H 17/20 |
| 11,473,306 | B2 * | 10/2022 | Nill | F16B 9/02 |
| 2006/0185270 | A1 * | 8/2006 | Handley | E04C 3/30 52/169.14 |
| 2009/0134377 | A1 * | 5/2009 | Petta | E04F 11/1817 256/65.01 |
| 2021/0262247 | A1 * | 8/2021 | Kightlinger | E04H 12/2261 |
| 2024/0309674 | A1 * | 9/2024 | Styrc | E04H 12/2269 |

* cited by examiner

POST AND RAILING MOUNT

CROSS REFERENCE TO RELATED APPLICATIONS

This application claims the benefit of U.S. Provisional Application No. 63/358,331 filed on Jul. 5, 2022. The above identified patent application is herein incorporated by reference in its entirety to provide continuity of disclosure.

BACKGROUND OF THE INVENTION

The present invention relates to a mount. More specifically, the present invention relates to a post and railing mount.

A newel, also called a central pole or support column, is the central supporting pillar of a staircase. It may also refer to an upright post that supports and/or terminates the handrail of a stair banister (the "newel post"). When constructing a banister or similar device, the handrail must be attached to the newel post. The newel post itself must also be attached to the base of the stairway. It may be difficult to attach the railing to the newel post. Fasteners must often be inserted at odd angles, which may damage both the railing and post if not done correctly. This may also lead to an unfinished or unpleasant appearance when both are installed. Typical fasteners and other mechanisms for securing the railing to the post are also not always as secure as they could be, leading to unwanted movement of the post or railing after installation, which may be dangerous.

Devices have been disclosed in the known art that are related to different types of post and railing mounts. These include devices that have been patented and that have been disclosed in published patent applications. However, these devices and systems have known drawbacks. For example, these devices fail to provide an integrated mounting system that provides an intermediate attachment point for the railing, such as a mounting bracket for example. Further, the devices in the known art lack a means for mounting the post in a more secure manner.

What is needed is a post and railing mount that provides an integrated mounting system that provides an intermediate attachment point for the railing in a more secure manner.

In light of the devices disclosed in the known art, it is submitted that the present invention substantially diverges in design elements from the known art and consequently it is clear that there is a need in the art for an improvement to existing railing and post mounting devices. In this regard the present invention substantially fulfills these needs.

SUMMARY OF THE INVENTION

In view of the foregoing disadvantages inherent in the known types of post and railing mounts now present in the prior art, the present invention provides a post and railing mount wherein the same may be utilized for providing convenience for the user when using the post and railing mount.

The present system comprises a post and railing mount having a mounting bracket having a plurality of vertical corner supports and a railing plate, and a newel corner post having a plurality of corners, each of the vertical corner supports are secured to each of the corners.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Reference is made herein to the attached figures. For the purposes of presenting a brief and clear description of the present invention, the preferred embodiments will be discussed as used for providing a mounting bracket for a post and railing. The figures are intended for representative purposes only and should not be considered to be limiting in any respect. Any dimensional numbers or measurements are included for example purposes only, and the present invention is not limited to any particular size, shape, or proportion.

Figure 1:
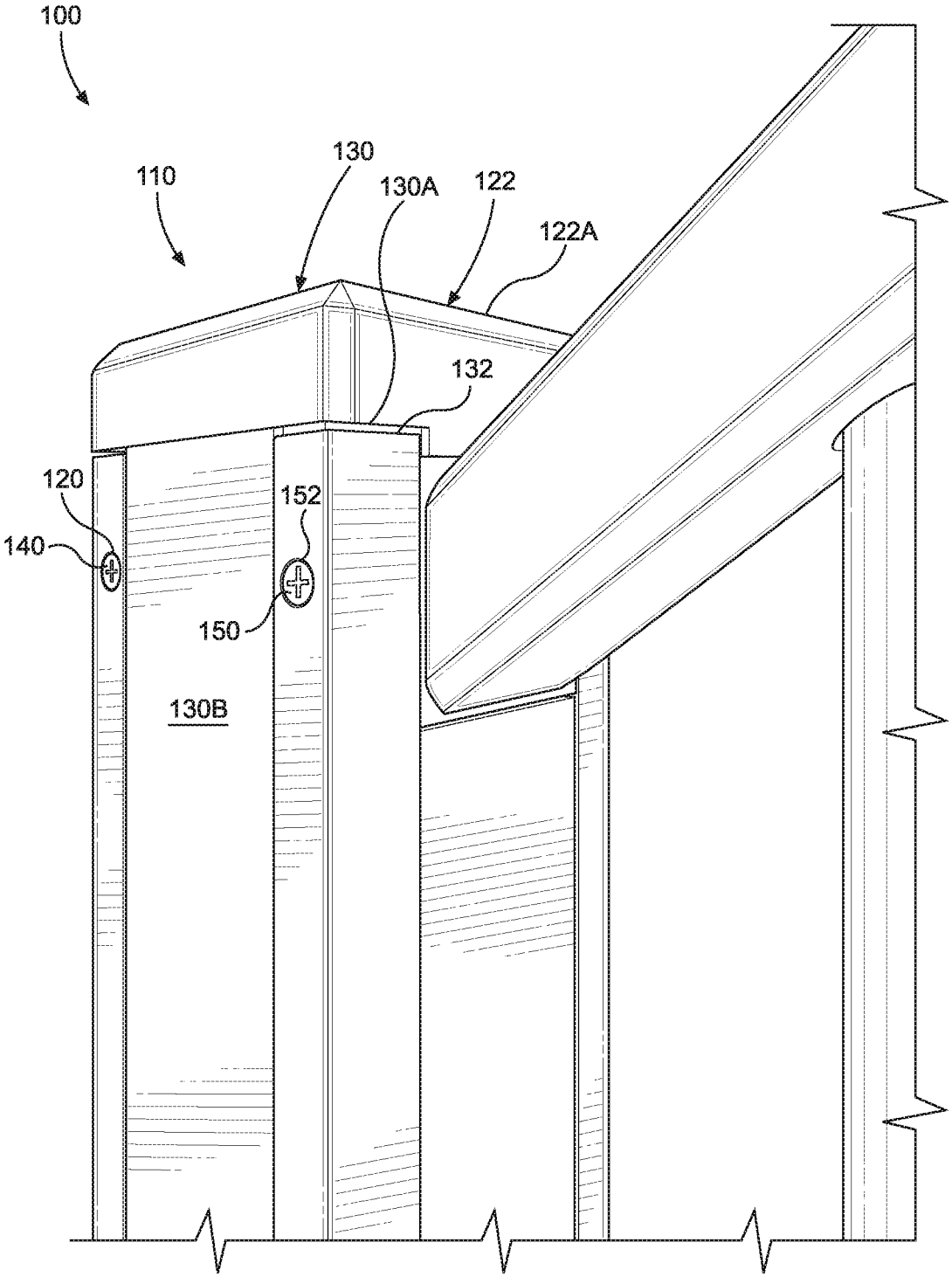
FIG. 1 shows a perspective view of an embodiment of the post and railing mount.

Referring now to FIG. 1, there is shown a perspective view of an embodiment of the post and railing mount 100.

The post and railing mount 100 may include a mounting bracket 110 which has a plurality of vertical corner supports 120 that secure to each corner 130A of a newel corner post 130, or the like.

Figure 6:
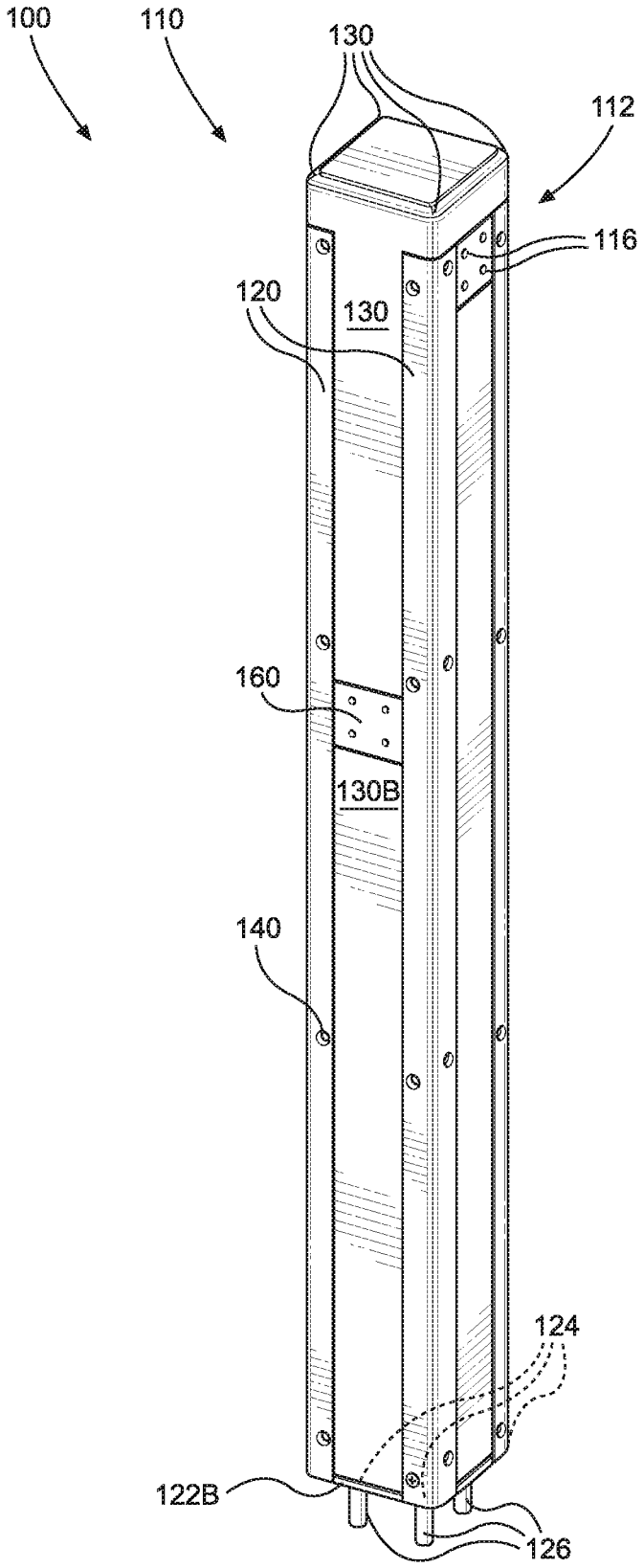
FIG. 6 shows a front perspective view of an embodiment of the post and railing mount.

In the shown embodiment, each of the vertical corner supports 120 may include a pair of perpendicular portions 122 that wrap around the corners 130A of the newel corner post 130. The pair of perpendicular portions 122 may include a top perpendicular portion 122A and a bottom perpendicular portion (FIG. 6, 122B). Further, in the shown embodiment, the corners 130A of the newel corner post 130 are recessed, such that the exterior face of the vertical corner supports 120 are flush with the surface 130B of the newel corner post 130. In the shown embodiment, each of the vertical corner supports 120 may include a plurality of apertures 140 that receive a plurality of mounting fasteners 150, such as a plurality of screws 152, for example. This allows the mounting bracket 110 to be securely mounted along the height of the newel corner post 130. There may be any number of mounting apertures (FIG. 6, 160), and other mechanisms may be utilized for securing the mounting bracket 110 to the newel corner post 130 if desired.

Figure 2:
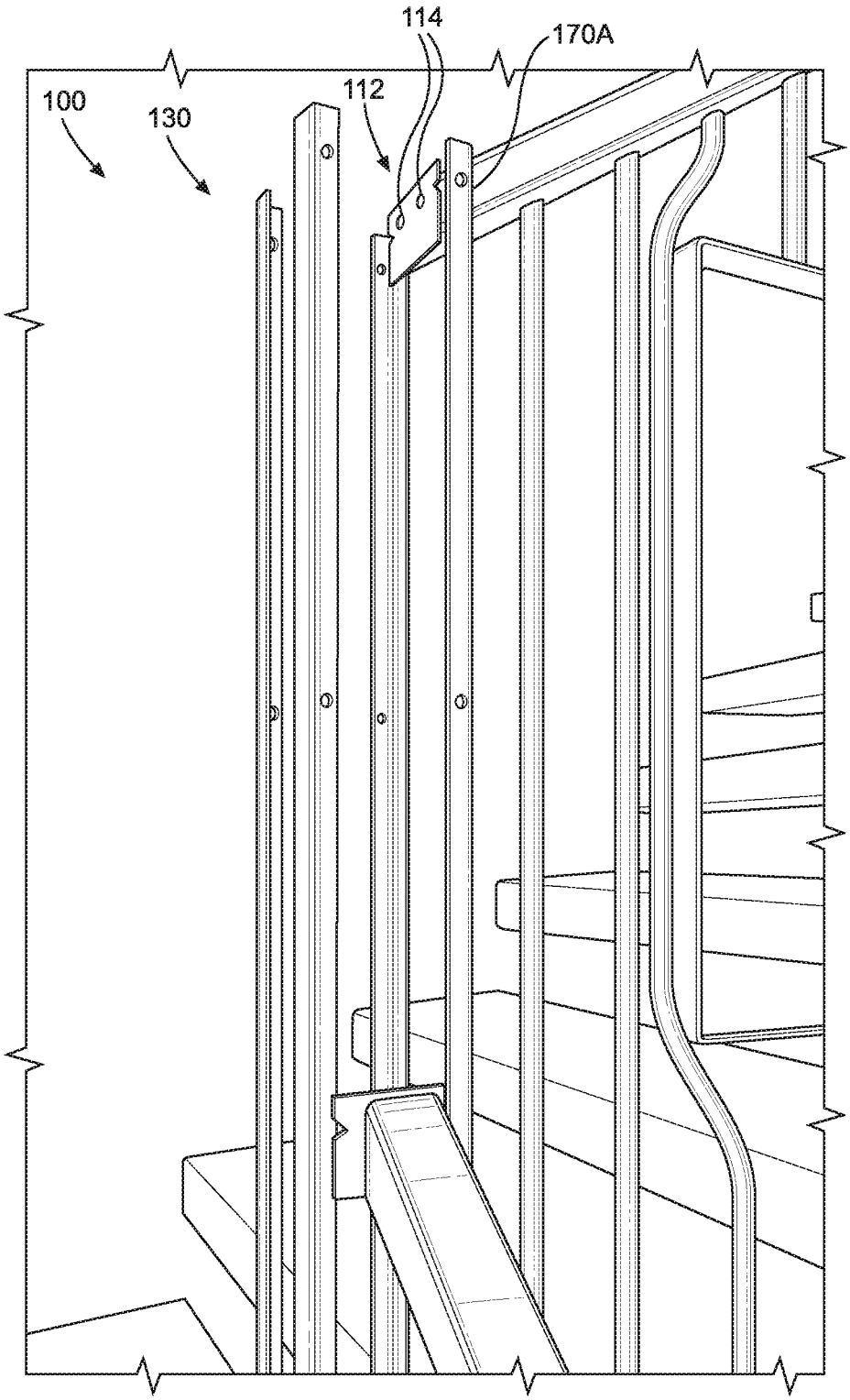
FIG. 2 shows a perspective view of an embodiment of the post and railing mount with the corner post removed.

Referring now to FIG. 2, there is shown a perspective view of an embodiment of the post and railing mount 100 with the newel corner post 130 removed.

The mounting bracket (FIG. 1, 110) further includes a railing plate 112. The distal end 170A of the railing 170 attaches to the railing plate 112. A plurality of apertures 114 disposed on the railing plate 112 allow for screws or similar fasteners (FIG. 6, 116) to secure the distal end 170A of the railing 170 to the railing plate 112. The railing plate 112 may engage between a pair of adjacent vertical corner supports 120 to affix the railing 170 to the newel corner post (FIG. 1, 130). In other embodiments, other fasteners 116 may be utilized to secure the railing 170 to the railing plate 112. In this way, the railing 170 is attached to the mounting bracket 110 rather than directly to the newel corner post 130.

Figure 3:
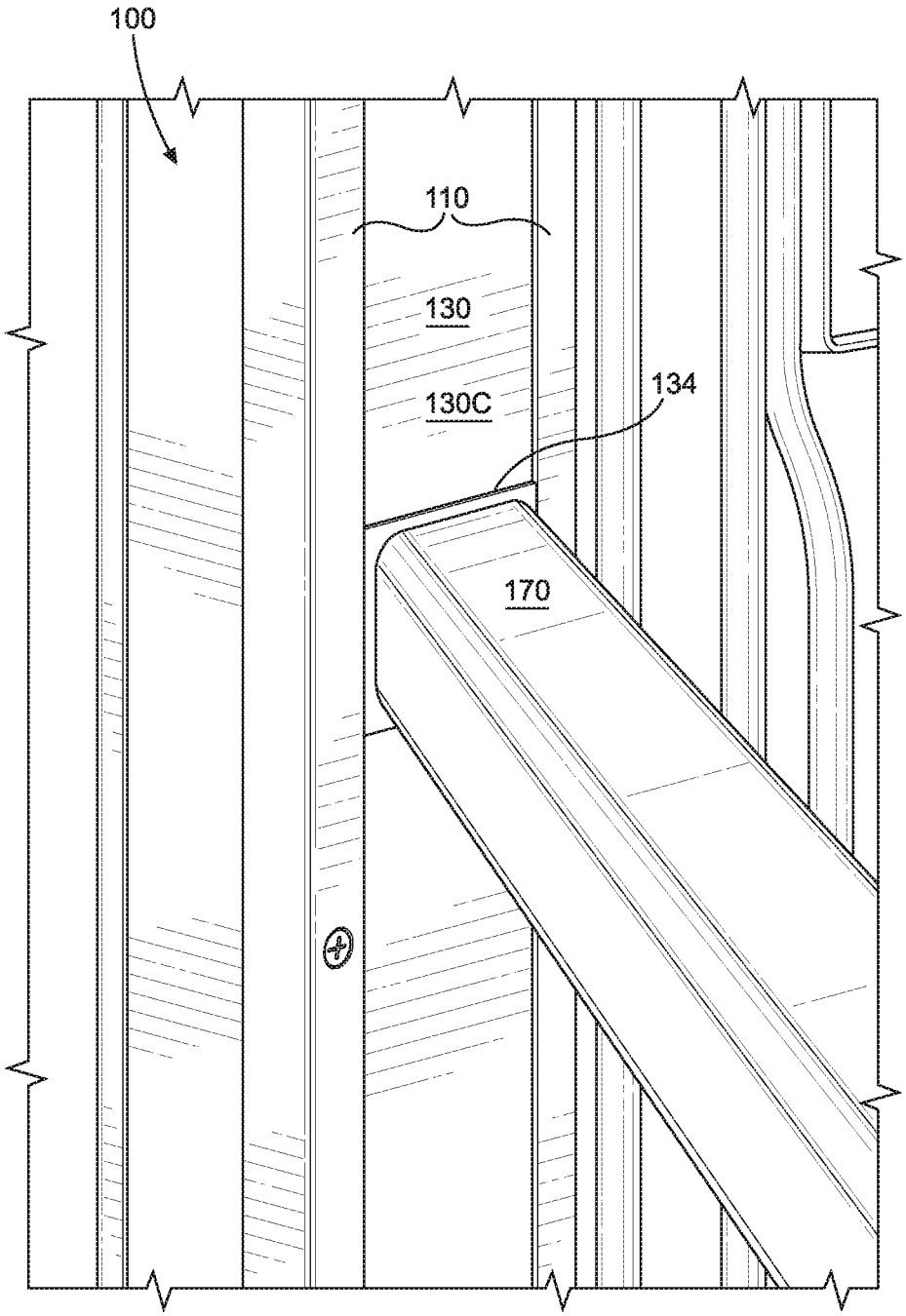
FIG. 3 shows an alternate perspective view of an embodiment of the post and railing mount.
Figure 4:
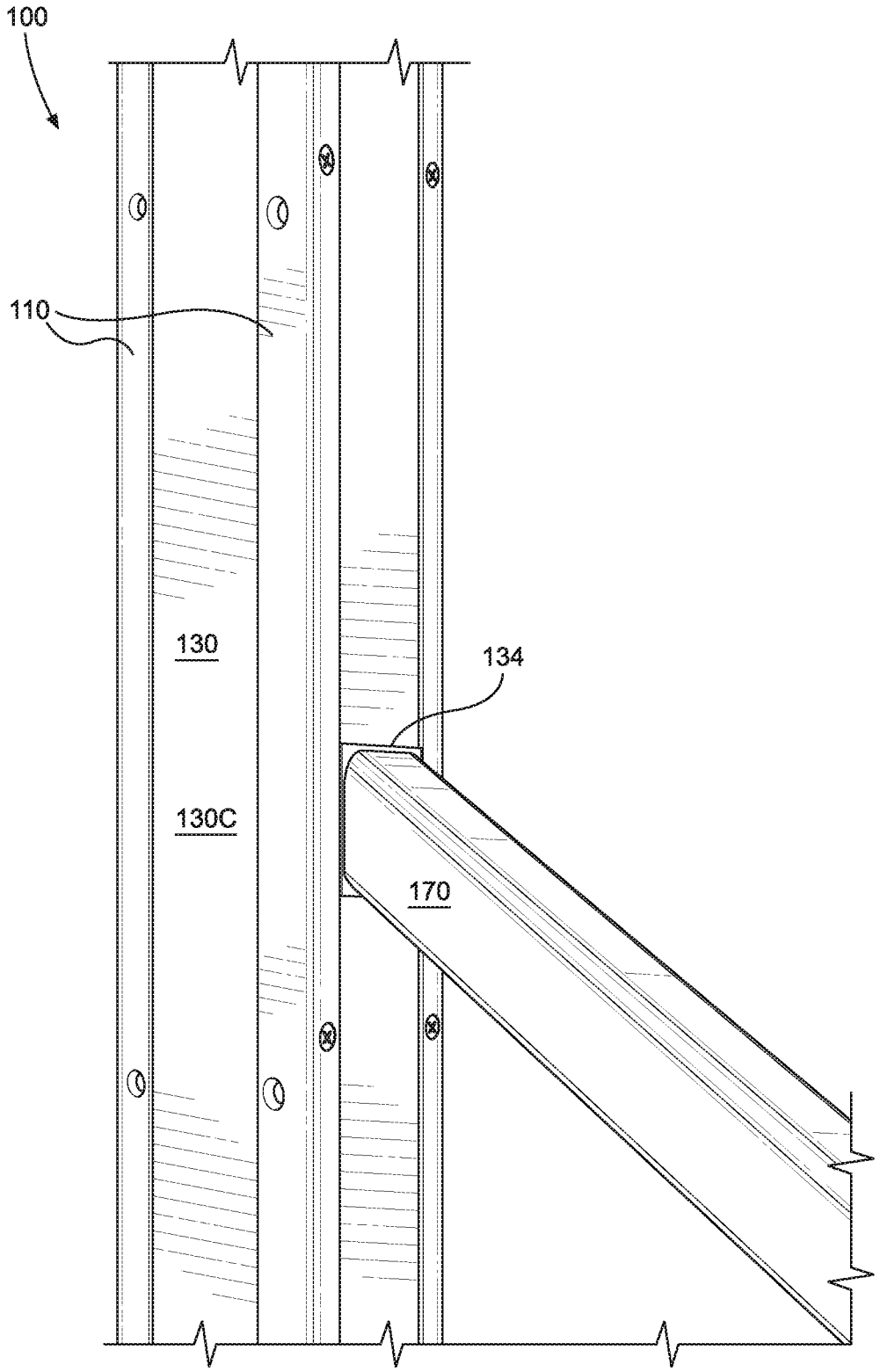
FIG. 4 shows an alternate perspective view of an embodiment of the post and railing mount.

Referring now to FIGS. 3 and 4, there are shown perspective views of an embodiment of the newel corner post 130 and post and railing mount 100 in use.

As shown, the mounting bracket 110 may be configured to secure a plurality of railings 170 to the newel corner post 130, for example in a landing configuration or other turn in the stairway, allowing for the railings 170 of the different stair sections to converge at and attach to the newel corner post 130.

Figure 5:
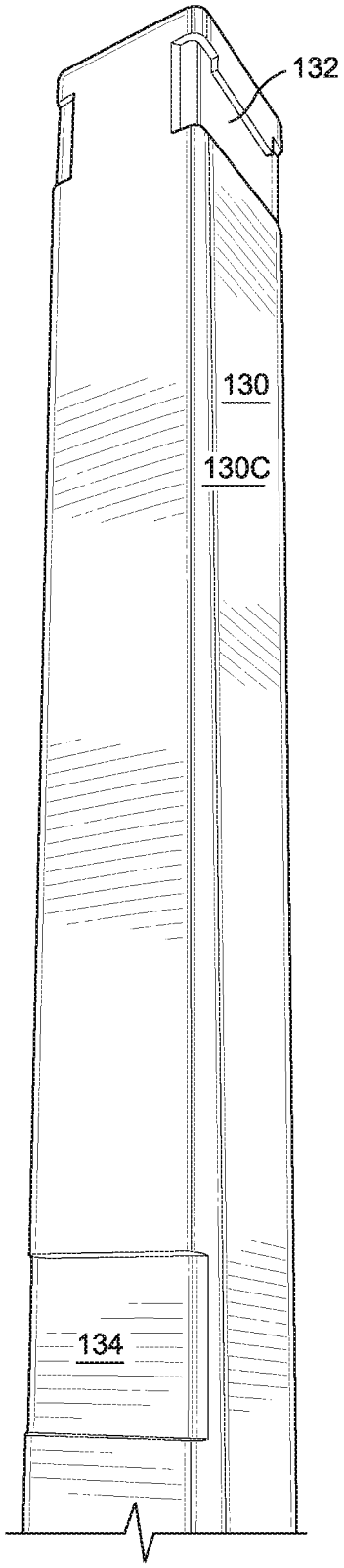
FIG. 5 shows a perspective view of the post component of the post and railing mount.

As shown in FIG. 5, the newel corner post 130 further includes a vertical recess 132 along each corner corresponding to the vertical corner supports (FIG. 1, 120), such that the vertical corner supports 120 rest flush with an exterior surface 130C of the newel corner post 130 when secured thereto. Additionally, one or more plate recesses 134 are disposed along the exterior of the newel corner post 130 to removably receive the railing plate (FIG. 2, 112) therein. In this manner, the newel corner post 130 may be configured for securement to the railings (FIG. 1, 170) at different heights of the newel corner post 130 to suit the staircase.

FIG. 6 shows a front perspective view of an embodiment of the post and railing mount 100.

The post and railing mount 100 may include a mounting bracket 110, a plurality of vertical corner supports 120, a newel corner post 130, a plurality of apertures 140, a plurality of mounting fasteners (FIG. 2, 150), and a plurality of mounting apertures 160.

The mounting bracket 110 may include a railing plate 112. A plurality of apertures 114 disposed on the railing plate 112 allow for screws or similar fasteners 116 to secure the distal end (FIG. 1, 170A) of the railing (FIG. 1, 170) to the railing plate 112.

The vertical corner supports 120 may secure to each corner 130A of a newel corner post 130. The vertical corner supports 120 may include a pair of perpendicular portions 122 that wrap around the corners 130A of the newel corner post 130. The pair of perpendicular portions 122 may include a top perpendicular portion 122A and a bottom perpendicular portion 122B. The bottom perpendicular portion 122B may include a plurality of apertures 124 to accommodate a plurality of corresponding fasteners 126 that extend through the apertures 124 to attach the bottom perpendicular portion 122B to a surface such as a floor or the like.

The newel corner post 130 may include a plurality of corners 130A and a surface 130B.

In operation, the mounting bracket 110 may be installed prior to installation of the newel corner post 130, such that the mounting bracket 110 provides a sturdy and guiding mounting location that defines the proper position of the newel corner post 130. The railings 170 may also be secured to the railing plates 122 prior to installing the newel corner post 130. The newel corner post 130 may then be secured within the mounting bracket 110, such that the vertical corner supports 120 of the mounting bracket 110 retain the corners 130A of the newel corner post 130, and the railing plates 122 fit flush within their respective recessed portions of the newel corner post 130.

The apertures 140 may receive a plurality of mounting fasteners (FIG. 1, 150), such as a plurality of screws (FIG. 1, 152), for example. This allows the mounting bracket 110 to be securely mounted along the height of the newel corner post 130.

The mounting fasteners 150 may be screws 152 or the like.

The mounting apertures 160 may secure the mounting bracket 110 to the newel corner post 130.

This allows the user to install the post and railing components of the stairway more quickly and easily. Further, the mounting bracket 110 provides a sturdy and safe mounting mechanism which also provides an improved appearance over a direct railing-to-post connection.

It is therefore submitted that the present invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A post and railing mount, comprising:

a mounting bracket having a plurality of vertical corner supports and a railing plate; and a newel corner post having a plurality of corners, wherein each of the vertical corner supports is secured to a corresponding corner of the newel corner post;

wherein the corners of the newel corner post are recessed, such that the exterior face of the vertical corner supports are flush with the surface of the newel corner post.

2. The post and railing mount of claim 1, wherein the vertical corner supports include a pair of perpendicular portions that wrap around the corners of the newel corner post.

3. The post and railing mount of claim 2, wherein the perpendicular portions include a top perpendicular portion and a bottom perpendicular portion.

4. The post and railing mount of claim 3, wherein the bottom perpendicular portion includes a plurality of apertures to accommodate a plurality of corresponding fasteners that extend through the apertures to attach the bottom perpendicular portion to a surface.

5. The post and railing mount of claim 4, wherein the surface is a floor.

6. The post and railing mount of claim 1, wherein each of the vertical corner supports include a plurality of apertures that receive a plurality of mounting fasteners.

7. The post and railing mount of claim 6, wherein the mounting fasteners are screws.

8. The post and railing mount of claim 1, further comprising a plurality of mounting apertures for securing the mounting bracket to the newel corner post.

9. The post and railing mount of claim 1, wherein a distal end of a railing is adapted to attach to the railing plate.

10. The post and railing mount of claim 9, further comprising a plurality of apertures disposed on the railing plate to allow for a plurality of fasteners to secure the distal end of the railing to the railing plate.

11. The post and railing mount of claim 10, wherein the fasteners are a plurality of screws.

12. The post and railing mount of claim 1, wherein the railing plate engages between a pair of adjacent vertical corner supports to affix the railing to the newel corner post.

13. The post and railing mount of claim 1, wherein the mounting bracket is installed prior to installation of the newel corner post, such that the mounting bracket provides a mounting location that defines the proper position of the newel corner post.

14. The post and railing mount of claim 1, further comprising one or more plate recesses are disposed along the exterior of the newel corner post to removably receive the railing plate therein.

15. The post and railing mount of claim 1, wherein the newel corner post is configured for securement to a plurality of railings at different heights of the newel corner post to accommodate a staircase.

16. The post and railing mount of claim 15, wherein the railings are secured to a plurality of railing plates prior to installing the newel corner post.

17. The post and railing mount of claim 16, wherein the newel corner post is secured within the mounting bracket, such that the vertical corner supports of the mounting bracket retain the corners of the newel corner post, and the railing plates fit flush within recessed portions of the newel corner post.

* * * * *